US008496446B2

(12) United States Patent
Lai

(10) Patent No.: US 8,496,446 B2
(45) Date of Patent: Jul. 30, 2013

(54) COMPRESSOR MUFFLER

(75) Inventor: Heng-Yi Lai, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 1553 days.

(21) Appl. No.: 11/991,338

(22) PCT Filed: Aug. 29, 2005

(86) PCT No.: PCT/US2005/030711

§ 371 (c)(1),
(2), (4) Date: Feb. 29, 2008

(87) PCT Pub. No.: WO2007/027168

PCT Pub. Date: Mar. 8, 2007

(65) Prior Publication Data

US 2009/0232670 A1 Sep. 17, 2009

(51) Int. Cl.

| | |
|---|---|
| ***F04B 39/00*** | (2006.01) |
| ***F04B 39/12*** | (2006.01) |
| ***F01N 1/02*** | (2006.01) |

(52) U.S. Cl.
USPC ..... 417/312; 181/264; 181/286; 181/403

(58) Field of Classification Search
USPC ..... 417/312; 181/264, 286, 403
See application file for complete search history.

(56) References Cited

U.S. PATENT DOCUMENTS

| | | | | |
|---|---|---|---|---|
| 3,880,245 | A | 4/1975 | Anderson, Jr. | 173/163 |
| 4,431,388 | A * | 2/1984 | Eber et al. | 418/55.1 |
| 6,280,154 | B1 | 8/2001 | Clendenin et al. | 417/410.5 |
| 6,290,022 | B1 * | 9/2001 | Wolf et al. | 181/292 |
| 6,360,555 | B1 | 3/2002 | Li et al. | 62/295 |
| 6,453,695 | B1 | 9/2002 | Marks et al. | 62/323.1 |
| 6,547,032 | B2 | 4/2003 | Yoon et al. | 181/229 |
| 6,792,907 | B1 | 9/2004 | Kostun et al. | 123/184.57 |
| 6,799,657 | B2 | 10/2004 | Daniels | 181/252 |
| 2002/0017425 | A1 * | 2/2002 | Yoon et al. | 181/292 |
| 2003/0075383 | A1 | 4/2003 | Ebbitt | 181/210 |
| 2003/0136607 | A1 | 7/2003 | Kawamata et al. | 181/231 |

OTHER PUBLICATIONS

International Search Report issued Oct. 10, 2006 for the corresponding International Application PCT/US2005/030711.

* cited by examiner

*Primary Examiner* — Charles Freay
*Assistant Examiner* — Philip Stimpert
(74) *Attorney, Agent, or Firm* — Cantor Colburn LLP

(57) ABSTRACT

A compressor muffler (100) for a refrigeration system is provided with an array of Helmholtz resonators (130, 230, 330) formed along an inner surface of a muffler chamber (110) of the muffler.

7 Claims, 3 Drawing Sheets

COMPRESSOR MUFFLER

BACKGROUND OF THE INVENTION

1. Field of the Invention

This invention relates generally to compressors and, more particularly, to a method and apparatus for noise control in compressors used in refrigeration systems.

2. Description of the Related Art

Compressors generate a high-pressure level of gas pulsation at the compressor discharge port or passage. This high-pressure level is a leading cause of internal mechanism failure, such as, for example, check valves. Additionally, the high-pressure level is a main source of noise and vibration problems.

Contemporary devices have attempted to address these problems with compressor mufflers that are reactive, i.e., designed based upon the volume change to reflect acoustic waves. As shown in U.S. Pat. No. 6,280,154, the scroll compressor has a cylindrical housing having welded at the upper end thereof a cap and at the lower end thereof a base. The cap is provided with a refrigerant discharge fitting which may have the usual discharge valve therein. A transversely extending partition is affixed to the housing by being welded about its periphery at the same point that the cap is welded to the housing. While such reactive mufflers can suppress some gas pulsation, they are of limited use where a more compact muffler is required or where a refrigerant requires a higher operating pressure.

Accordingly, there is a need for a compressor muffler that can withhold higher gas pulsation, even at higher operating pressures. There is a further need for such a muffler that can generate lower noise and vibration within a desired physical size and/or shape limitation.

It is an object of the present invention to provide a compressor muffler that absorbs sound generated from gas pulsation.

It is a further object of the present invention to provide such a compressor muffler that efficiently absorbs such sound over a wide range of frequencies.

It is yet a further object of the present invention to provide such a compressor muffler that provides a compact size.

SUMMARY OF THE INVENTION

In one aspect, a muffler is provided for a compressor used in a refrigeration system. The muffler has a muffler chamber defined in part by a cap and has an intake and an exhaust. The cap has an inner surface with at least a portion that is opposite to the intake. The inner surface has a plurality of Helmholtz resonators.

In another aspect, a scroll compressor for a refrigeration system is provided which comprises a non-orbiting scroll member, an orbiting scroll member, a crankshaft, and a muffler. The non-orbiting scroll member is meshingly engaged with orbiting scroll member. The crankshaft is operably connected to the orbiting scroll member. The muffler has a muffler chamber with an intake and an exhaust. The intake is in fluid communication with the non-orbiting scroll member. The muffler chamber is defined at least in part by a cap having an inner surface with a plurality of Helmholtz resonators.

In yet another aspect, a method of absorbing sound in a compressor used in a refrigeration system is provided which comprises providing a liner having a plurality of orifices, with at least one of the orifices having a first diameter that is different from a second diameter of another of the orifices; positioning the liner along an inner surface of a muffler chamber; and directing the sound into the muffler chamber and across a plurality of Helmholtz resonators that are defined at least in part by the plurality of orifices.

The muffler can further comprise a liner having a plurality of perforations, with the liner being connected to the inner surface thereby forming a gap between the liner and the inner surface. The plurality of perforations may be in fluid communication with the gap, and each of the plurality of perforations can form or partially form one of the plurality of Helmholtz resonators. The muffler can further comprise a liner having a plurality of holes, with the liner being connected to the inner surface, and the holes being in substantially fluid isolation from each other. The perforations or holes can have different diameters. The perforations or holes can have varying spacing therebetween. The liner may have a shape that corresponds to a shape of the inner surface of the cap. The muffler may further comprising a sound absorbing material. The sound absorbing material can be positioned in the gap between the liner and the inner surface of the cap.

The above-described and other features and advantages of the present disclosure will be appreciated and understood by those skilled in the art from the following detailed description, drawings, and appended claims.

DETAILED DESCRIPTION OF THE INVENTION

Figure 1:
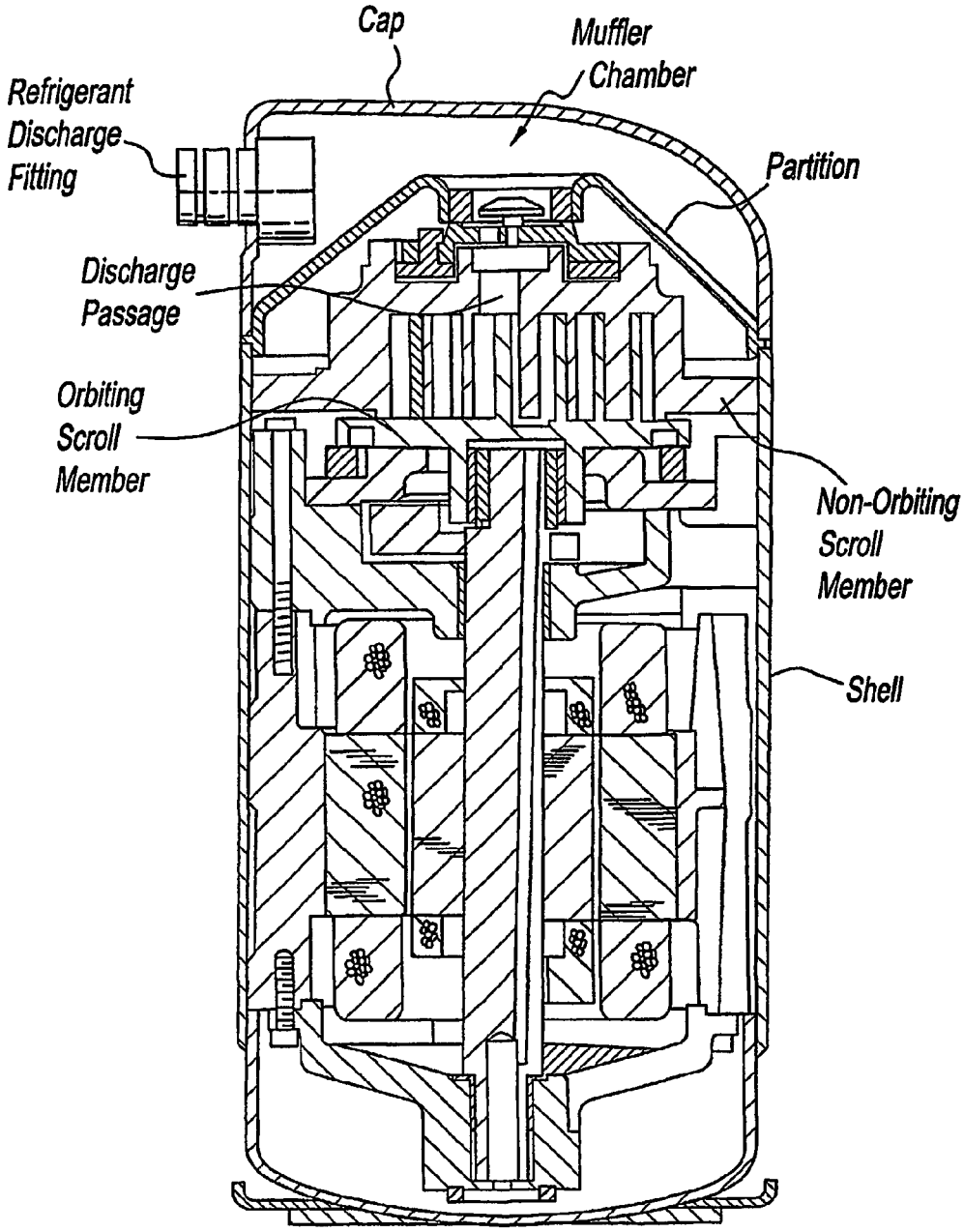
Fig. 1 (Prior Art)
FIG. 1 is a cross-sectional illustration of a contemporary scroll compressor having a muffler chamber as shown in U.S. Pat. No. 6,280,154.
Figure 2:
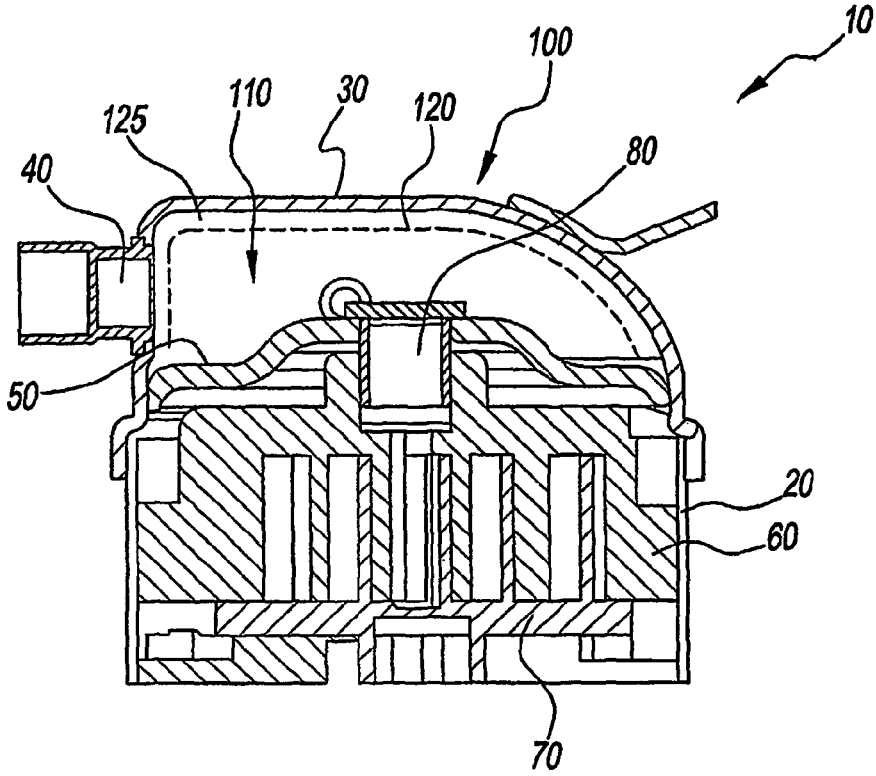
FIG. 2 is a schematic cross-sectional illustration of a portion of a scroll compressor having a muffler in accordance with an exemplary embodiment of the present invention.

Referring now to FIG. 2, a top portion of a scroll compressor is shown and generally represented by reference numeral 10. The scroll compressor 10 has a generally hermetic housing 20, which is cylindrical, although alternative shapes are also contemplated. The housing 20 has a cap 30 welded or otherwise connected to an upper end of the housing. The cap 30 has a refrigerant discharge fitting or exhaust 40, which may have a discharge valve therein (not shown). A partition 50 is connected to the cap 30 and/or housing 20. Preferably, the partition 50 transversely extends across the lower opening of the cap 30 and is connected to the cap by being welded about its periphery in proximity to where the cap is welded to the housing 20.

A non-orbiting scroll member 60 is positioned in meshing engagement with an orbiting scroll member 70 to provide for compression of the refrigerant. The scroll compressor 10 has various other components known in the art to allow for compression of the refrigerant, such as, for example, a motor, crankshaft, bearings, conduits and seals. The details of these components has been omitted for brevity but are contemplated by the present disclosure and are known by one of ordinary skill in the art.

The scroll compressor 10 has a compressor muffler in accordance with an exemplary embodiment of the present invention and generally represented by reference numeral 100. The muffler 100 has a muffler chamber 110 and a shell or liner 120 positioned in the chamber. The muffler chamber 110 is defined in part by cap 30 and partition 50. However, the present disclosure contemplates other structures defining or partially defining the muffler chamber 110, such as, for example, support members. The non-orbiting scroll member 60 has a centrally disposed intake or passage 80, which is in fluid communication with the discharge muffler chamber 110, and the refrigerant discharge fitting or exhaust 40 is also in fluid communication with the chamber 110. While the exemplary embodiment is described with respect to scroll compressor 10, the present disclosure contemplates the use of compressor muffler 100 with other types of compressors used in refrigeration systems. Also, preferably, at least a portion of the liner 120 and/or the inner surface of the cap 30 is positioned opposite to intake 80.

Figure 3:
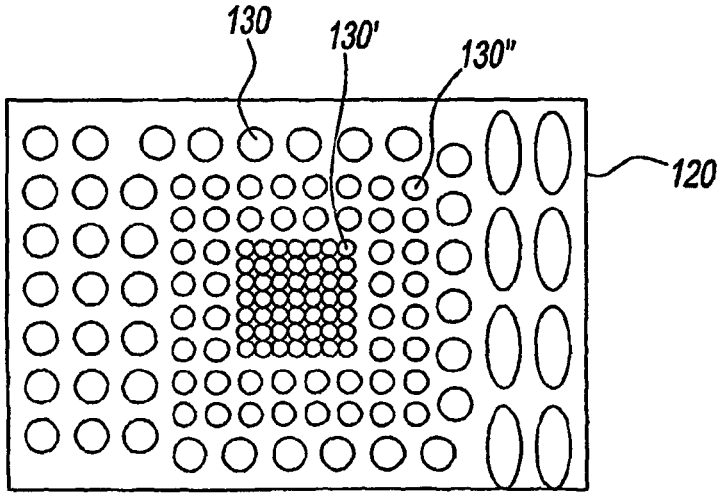
FIG. 3 is a schematic plan view of an internal liner of the muffler of FIG. 2.

Referring to FIGS. 2 and 3, liner 120 has a size and shape that corresponds to the size and shape of cap 30 but smaller thereby allowing the liner to be fitted into the cap and defining a gap or space 125 therebetween. The liner 120 can be connected to the cap 30 and/or partition 50 by welding or other connecting structures or methods. Preferably, the liner 120 is connected to the inner surface of the cap 30 along the periphery of the liner by welding.

The liner 120 has a number of perforations or orifices 130 therethrough that are in fluid communication with the gap 125. The perforations 130 form an array of Helmholtz resonators, which absorb the sound, e.g., compressor gas pulsation, that is generated by the scroll compressor 10 and which passes through the muffler chamber 110. Liner 120 preferably has perforations 130 having different diameters so as to absorb sound over a broader range of frequencies.

The particular size and number of the perforations 130 can be varied to increase the sound absorbing characteristics of liner 120 depending upon the sound being generated by the particular scroll compressor 10. Such parameters as perforation diameter and perforation ratio can be evaluated to increase the sound absorbing characteristics of the liner 120. Additionally, the positioning of the perforations 130 can also be varied according to the particular geometry of the muffler chamber 110, as well as the sound being generated by the scroll compressor 10, such as, for example, having first perforations 130' with a first diameter and being located directly opposite to the intake 80, and having second perforations 130" with a second diameter and being located adjacent to the first perforations.

The spacing between the perforations 130 can also be varied to improve the sound absorbing characteristics of liner 120. In the exemplary embodiment, perforations 130 are shown with a circular or substantially circular shape. However, the present disclosure contemplates alternative shapes also being used to improve the sound absorbing characteristics of the Helmholtz resonators. The thickness of the liner 120 can also be varied to provide a more efficient throat or neck for improved sound absorbing characteristics for each of the Helmholtz resonators. The size of gap 125 can be varied to further increase the sound absorbing characteristics of liner 120. The size of gap 125, e.g., the distance between the liner 120 and the inner surface of the cap 30, can be varied to control the peak frequency of the sound that is absorbed. Typically, a deeper gap 125 will provide for a lower absorbing peak frequency.

By adjusting the diameter of the perforations 130, the perforation ratio for the liner 120 and the thickness of the liner, the muffler 100 can be provided with a sound absorption coefficient with a maximum peak that is in proximity to the frequency of the gas pulsation, while also tuning for absorption of a broader range of frequencies.

In the exemplary embodiment of FIGS. 2 and 3, the liner 120 is welded to the cap 30 along the periphery of the liner. This facilitates the manufacture and assembly process, while also maximizing the available surface area for positioning of the perforations 130. However, the present disclosure contemplates other connection structures and methods being utilized for connection of the liner 120 to the cap 30. In one such alternative connection structure, one or more support members (not shown) are positioned between the liner 120 and the cap 30. The support members serve to secure the liner 120 to the cap 30, and can also form a plurality of gaps or spaces 125 between the liner and the cap thereby isolating one or more of the perforations 130 from one another. The support members can also be used to form separate gaps or spaces 125 for each set of perforations 130 that have the same or similar diameters.

Muffler 100 can also have a sound absorbing material positioned in the gap 125 to further increase the sound absorbing characteristics for each of the perforations 130. The liner 120 can be made from a material that allows for connection with the cap 30 and facilitates the manufacturing process but is rigid enough to withstand the gas pulsations generated by the scroll compressor 10.

Figure 4:
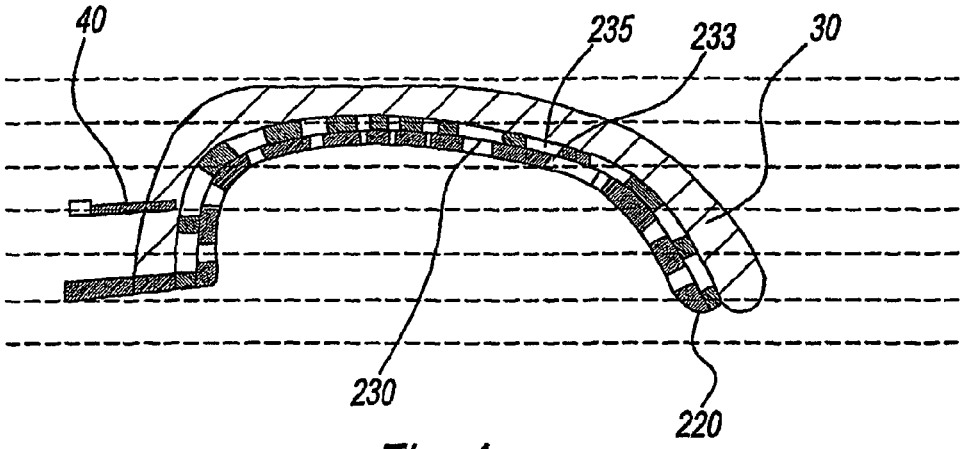
FIG. 4 is a cross-sectional view of an alternative internal liner according to another exemplary embodiment of the present invention.

Referring to FIG. 4, an alternative internal shell or liner according to another exemplary embodiment of the present invention is shown and generally represented by reference numeral 220. Liner 220 has a size and shape that corresponds to the size and shape of cap 30 but smaller thereby allowing the liner to be fitted into the cap. The liner 220 can be connected to the cap 30 and/or partition 50 by welding or other connecting structures or methods. Preferably, the liner 220 is connected to the inner surface of the cap 30 along the periphery of the liner by welding. Unlike the embodiment of FIG. 3, the liner 220 preferably abuts or substantially abuts up against the inner surface of the cap 30 thereby removing the gap between the liner and the cap. However, as will be described below, the gap is replaced by individual volumes to define in part the Helmholtz resonators.

The liner 220 has a number of holes or orifices 230 formed therein. In the exemplary embodiment of FIG. 4, each of the holes 230 includes a resonator neck or throat 233 connected to a volume 235. Thus, the holes 230 including the necks 233 and volumes 235 form an array of separate or isolated Helmholtz resonators, which absorb the sound, e.g., compressor gas pulsation, that is generated by the scroll compressor 10 and passes through the muffler chamber 110. Similar to liner 120 described above, the diameter of the holes 230, the length of the resonator necks 233, the size of the volumes 235, the hole ratio for the liner 220 and the thickness of the liner (e.g., a combination of varying the resonator necks and the volumes) can be adjusted thereby providing the muffler 100 with a sound absorption coefficient having a maximum peak that is in proximity to the frequency of the gas pulsation, while also tuning for absorption of a broader range of frequencies.

To form the holes 230 to include a resonator neck 233 connected to the volume 235, the liner 220 may be two separate liners (one having the resonator necks 233 and the other having the volumes 235) that are overlapped or connected to each other, or the liner can be a single, integral liner that is machined or otherwise provided with the Helmholtz resonators formed therein. Additionally, the size or length of the resonator necks 233 can be further varied by drilling or otherwise forming the holes 233 at a non-perpendicular angle with respect to the liner 220 to increase the length of the necks and increase energy dissipation.

Figure 5:
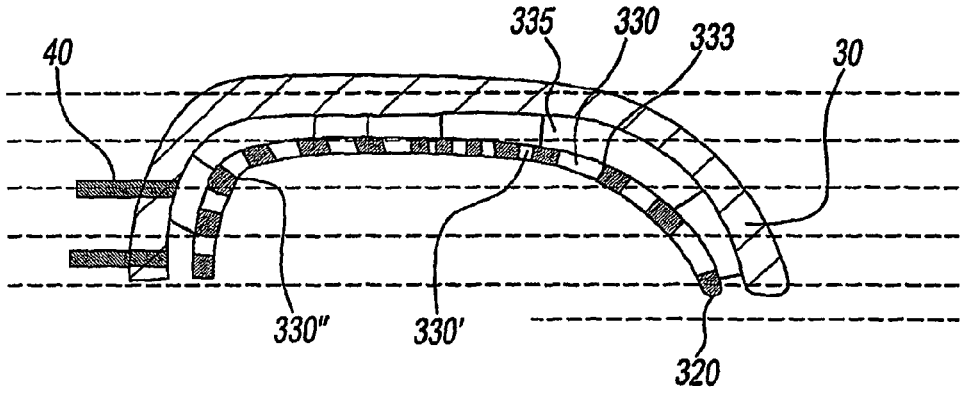
FIG. 5 is a cross-sectional view of an alternative internal liner according to yet another exemplary embodiment of the present invention.

Referring to FIG. 5, an alternative internal shell or liner according to yet another exemplary embodiment of the present invention is shown and generally represented by reference numeral 320. Liner 320 has a size and shape that corresponds to the size and shape of cap 30 but smaller thereby allowing the liner to be fitted into the cap. The liner 320 can be connected to the cap 30 and/or partition 50 by welding or other connecting structures or methods. Preferably, the liner 320 is connected to the inner surface of the cap 30 along the periphery of the liner by welding. Unlike the embodiment of FIG. 3, the liner 320 preferably abuts or substantially abuts up against the inner surface of the cap 30 thereby removing the gap between the liner and the cap. However, as will be described below, the gap is replaced by a honeycomb-like structure providing individual volumes to define in part the Helmholtz resonators.

The liner 320 has a number of holes or orifices 330 formed therein. In the exemplary embodiment of FIG. 5, each of the holes 330 includes a resonator neck or throat 333 connected to a volume 335. A plurality of volumes 335 are defined by a honeycomb-like structure. Thus, the holes 330 including the necks 333 and volumes 335 form an array of Helmholtz resonators, which absorb the sound, e.g., compressor gas pulsation, that is generated by the scroll compressor 10 and passes through the muffler chamber 110. In this alternative embodiment, the liner 320 includes a honeycomb-like structure that provides an array of Helmholtz resonators of differing diameters (e.g., holes 330, 330' and 330") for reduction of gas compressor pulsation. The volumes 335 can be in fluid communication with one or more of the resonator necks 333. Similar to liners 120 and 220 described above, the diameter of the holes 330, the length of the resonator necks 333, the size of the volumes 335, the hole ratio for the liner 320 and the thickness of the liner (e.g., a combination of varying the resonator necks and the volumes) can be adjusted thereby providing the muffler 100 with a sound absorption coefficient having a maximum peak that is in proximity to the frequency of the gas pulsation, while also tuning for absorption of a broader range of frequencies.

The honeycomb-like structure forming volumes 335 can be a separate liner that is connected to a liner having resonator necks 333, or the liner can be a single, integral structure with the holes 330 machined or otherwise formed therein. Additionally, the size or length of the resonator necks 333 can be further varied by drilling or otherwise forming the holes 333 at a non-perpendicular angle with respect to the liner 320 to increase the length of the necks and increase energy dissipation. Additionally, liner 320 can be a combination of isolated holes 330 and perforations (in fluid communication with a partial gap formed between a portion of the liner and the cap 30).

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling within the scope of the appended claims.

What is claimed is:

1. A muffler for a compressor used in a refrigeration system comprising:

a muffler chamber being defined in part by a cap and having an intake and an exhaust, wherein said cap has an inner surface, wherein said inner surface has a plurality of Helmholtz resonators, and wherein at least a portion of said inner surface is opposite to said intake;

a liner having a plurality of perforations, wherein said liner is connected to said inner surface thereby forming a gap between said liner and said inner surface, wherein said plurality of perforations are in fluid communication with said gap, and wherein each of said plurality of perforations at least partially forms one of said plurality of Helmholtz resonators;

the liner extending across the entire interior surface of the cap and secured to the cap along the periphery of the liner.

2. The muffler of claim 1, wherein at least one of said plurality of perforations has a first diameter that is different from a second diameter of at least another of said plurality of perforations.

3. The muffler of claim 2, wherein at least one pair of said plurality of perforations has a first spacing that is different from a second spacing of at least another pair of said plurality of perforations.

4. A scroll compressor for a refrigeration system comprising:

a non-orbiting scroll member;

an orbiting scroll member meshingly engaged with said non-orbiting scroll member;

a crankshaft operably connected to said orbiting scroll member; and a muffler having a muffler chamber with an intake and an exhaust said intake being in fluid communication with said non-orbiting scroll member wherein said muffler chamber is defined at least in part by a cap having an inner surface with a plurality of Helmholtz resonators;

a liner having a plurality of perforations, wherein said liner is connected to said inner surface thereby forming a gap between said liner and said inner surface, wherein said plurality of perforations are in fluid communication with said gap, and wherein each of said plurality of perforations at least partially forms one of said plurality of Helmholtz resonators;

the liner extending across the entire interior surface of the cap and secured to the cap along the periphery of the liner.

5. The compressor of claim 4, wherein at least one of said plurality of perforations has a first diameter that is different from a second diameter of at least another of said plurality of perforations.

6. The compressor of claim 4, wherein at least one pair of said plurality of perforations has a first spacing that is different from a second spacing of at least another pair of said plurality of perforations.

7. A muffler for a compressor used in a refrigeration system comprising:

a muffler chamber being defined in part by a cap and having an intake and an exhaust, wherein said cap has an inner surface, wherein said inner surface has a plurality of Helmholtz resonators, and wherein at least a portion of said inner surface is opposite to said intake;

a liner having a plurality of holes, wherein said liner is connected to said inner surface, wherein said plurality of holes are substantially in fluid isolation from each other, and wherein each of said plurality of holes at least partially forms one of said plurality of Helmholtz resonators;

wherein the holes in the liner directly across from the intake have a first diameter that is smaller than a second diameter of holes positioned at periphery of the liner, such that the holes in the liner have an increasing diameter as the distance between the holes and the intake increases.

* * * * *